United States Patent [19]

Duncan

[11] 4,090,203

[45] May 16, 1978

[54] LOW SIDELOBE ANTENNA SYSTEM EMPLOYING PLURAL SPACED FEEDS WITH AMPLITUDE CONTROL

[75] Inventor: James W. Duncan, Placentia, Calif.

[73] Assignee: TRW Inc., Redondo Beach, Calif.

[21] Appl. No.: 617,563

[22] Filed: Sep. 29, 1975

[51] Int. Cl.[2] ..... H01Q 3/26

[52] U.S. Cl. ..... 343/753; 343/778; 343/797; 343/840

[58] Field of Search ..... 343/776, 777, 778, 840, 343/753, 797, 100 LE

[56] References Cited

U.S. PATENT DOCUMENTS

| | | | |
|---|---|---|---|
| 3,234,559 | 2/1966 | Bartholoma et al. | 343/779 |
| 3,495,262 | 2/1970 | Clark | 343/776 |
| 3,553,706 | 1/1971 | Charlton | 343/776 |
| 3,633,208 | 1/1972 | Ajioka | 343/854 |
| 3,740,754 | 6/1973 | Epis | 343/797 |
| 3,811,129 | 5/1974 | Holst | 343/854 |
| 3,936,835 | 2/1976 | Phelan | 343/840 |

*Primary Examiner*—Eli Lieberman

*Attorney, Agent, or Firm*—R. W. Keller; B. DeWitt; D. R. Nyhagen

[57] ABSTRACT

Various antenna systems are disclosed which generate a shaped beam having a substantially Gaussian distribution substantially without sidelobes. The antenna system consists of basic subarrays consisting of seven or nine radiating elements arranged respectively in a circle with a central element or in the form of a square. The radiating elements are fed in phase but the power applied to each element and the spacing is so selected that due to interference the sidelobes substantially disappear. More complex antenna arrays to form different beam shapes may be formed from the two basic subarrays.

14 Claims, 20 Drawing Figures

LOW SIDELOBE ANTENNA SYSTEM EMPLOYING PLURAL SPACED FEEDS WITH AMPLITUDE CONTROL

BACKGROUND OF THE INVENTION

This invention relates generally to antennas and particularly relates to antenna systems characterized by radiated beams having very low sidelobes.

For various applications it is necessary, or at least very advantageous, to be able to radiate a beam having a shaped or predetermined cross-section. Such a beam is capable of illuminating a particular solid angle of space or a specified region on the ground substantially without overlap. This is particularly important for communication purposes where a satellite antenna must illuminate a particular country, state or time zone which may have an irregular shape. This is particularly important to save the frequency spectrum so that different programs may be sent simultaneously into different areas without interference with each other.

In the past, attempts have been made to shape antenna beams. This work was begun in World War II for the purpose of developing microwave antennas for radar applications. This can be effected by multi-element feed array which in turn is used to illuminate a paraboloidal reflector or a lens. Alternatively, the shape of the reflector may be modified to shape the beam by dispersing the rays.

Thus for communication applications, attempts have beem made to illuminate the desired region with a multiplicity of contiguous spot beams. Each spot beam is the main lobe cross-section of a conventional diffraction pattern which is produced by a single feed illuminating a reflector or lens. The desired configuration was then achieved by simply summing the signal voltages of each of the feed elements. However, poor regional configuration is obtained with this technique. In addition, due to the multiple feeds which are displaced from the focal point of the reflector or lens, high sidelobes result. This, of course, means that areas adjacent to the desired zone of coverage are illuminated by substantial power causing highly undesirable interference.

One reason for the poor results is that the radiation patterns of all antennas utilizing lenses and reflectors are seriously degraded when the radiating element is displaced from the focus of the lens or reflector. This is particularly true with the paraboloidal reflector because the sidelobes caused by the diffraction pattern increase substantially in amplitude as the radiating element is displaced from the focal point.

It is accordingly an object of the present invention to provide an antenna array producing a beam of generally Gaussian distribution and substantially without sidelobes.

Another object of the invention is to provide an antenna array of the type which can be relatively simply realized because each radiating element is in co-phase with the others and the powers fed to the elements can be simply determined, whereby the element excitation coefficients are real rather than complex.

A further object of the present invention is to provide an antenna of the type discussed where the spacing between radiating elements and the power excitation can be readily calculated for the desired result of obtaining a Gaussian-shaped beam.

Still another object of the present invention is to provide an antenna array capable of producing a beam of predetermined shape substantially without overlap and with a generally Gaussian distribution.

SUMMARY OF THE INVENTION

In accordance with the present invention there is provided an antenna system consisting of one or more basic subarrays. A subarray may consist of seven radiating elements arranged in a circle about a central element. Another basic subarray may consist of nine elements arranged in a square, that is in three rows of three elements each.

The elements are fed with a wave to be radiated so that each element is in phase with the others and so that the power is predetermined to obtain the desired result. For example, for the seven-element subarray the outer elements arranged in a circle are all fed with the same power, while the central element is fed with the same power times a constant.

The elements are coupled to a focusing means such as an offset paraboloid reflector or a lens.

The radiating elements may, for example, consist each of a horn or of a pair of crossed dipoles. Of course, other known radiating elements may be used instead.

Basically the arrangement is such that substantially all radiation outside of a predetermined pattern is cancelled by interference. In other words, the distribution is Gaussian and the sidelobes are substantially at a minimum.

The novel features that are considered characteristic of this invention are set forth with particularity in the appended claims. The invention itself, however, both as to its organization and method of operation, as well as additional objects and advantages thereof, will best be understood from the following description when read in connection with the accompanying drawings.

DESCRIPTION OF THE PREFERRED EMBODIMENTS

Figure 1:
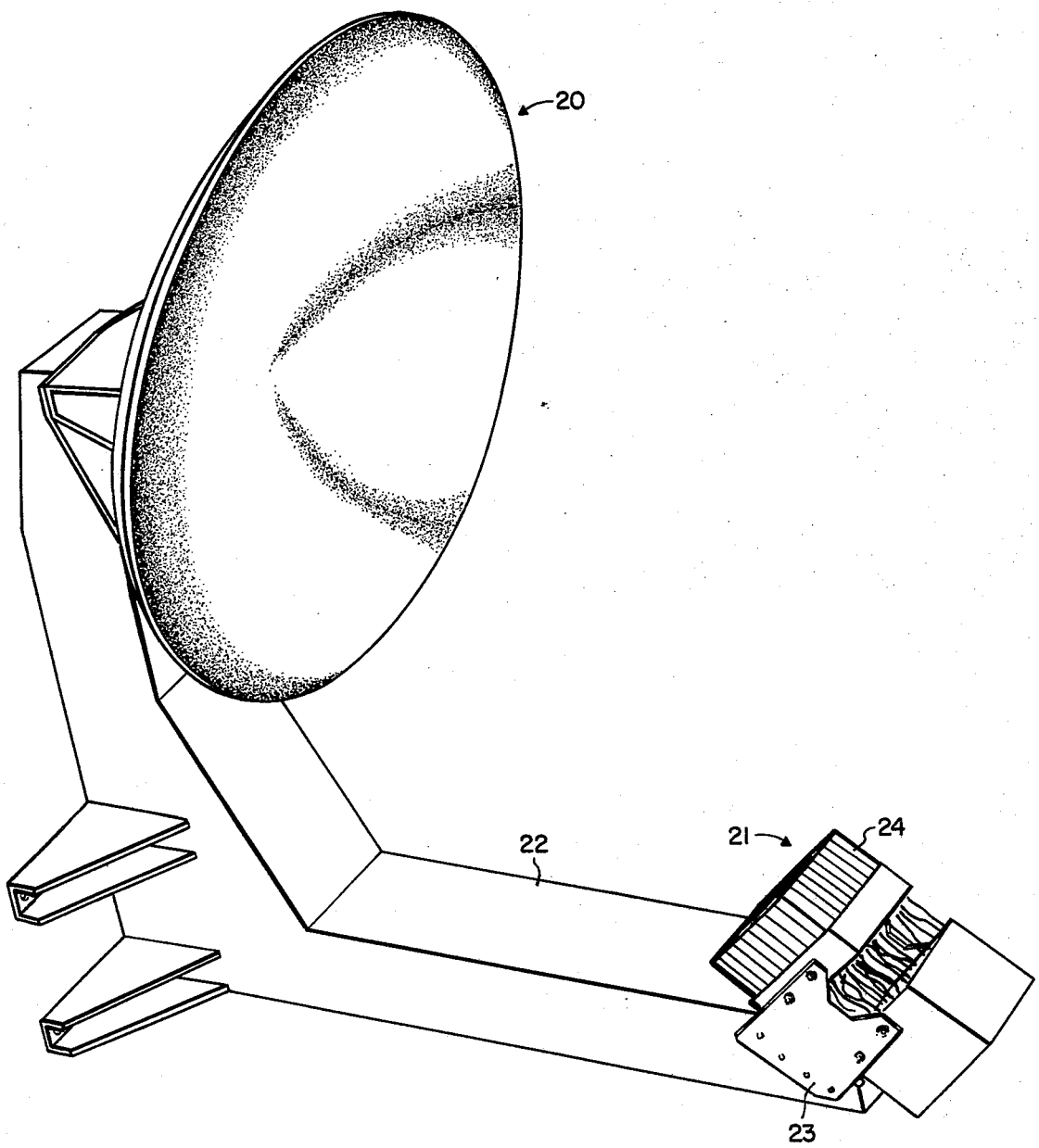
FIG. 1 is a view in perspective of an antenna array embodying the present invention and consisting of a multiplicity of radiating elements such as horns and an offset paraboloid reflector.

Referring now to the drawings and particularly to FIGS. 1 - 7, there is illustrated an embodiment of the invention which by way of example may consist of a basic subarray of seven radiating elements. The seven radiating elements may, for example, consist of horns and may be arranged so that six elements are disposed in a circle about a central radiator. Furthermore, the embodiment of FIGS. 1 - 7 includes an off-axis reflector such as a paraboloidal reflector.

Thus, referring to FIG. 1, there is illustrated a reflector 20 such as a paraboloidal reflector illuminated off-axis by a radiator array 21. The reflector 20 and the radiator array structure 21 may be rigidly mounted on a bracket 22 which support the array 21 by a pair of plates 23. Actually, the antenna array 24 of FIG. 1 consists of more than seven elements. Various configurations of the radiating elements will be subsequently described, particularly by reference to FIGS. 11 - 15.

Figure 2:
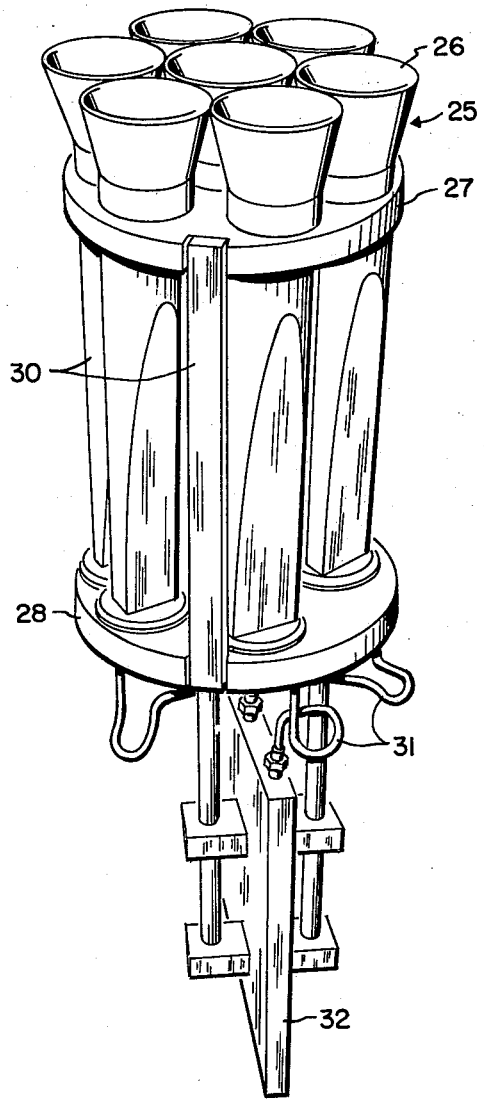
FIG. 2 is a view in perspective of an array of horn radiators such as a basic subarray consisting of seven elements.

Referring now to FIG. 2, there is illustrated an array 25 of radiating elements such as the horns 26. As explained before, the array 25 consists of seven elements which may be termed one of the basic subarrays of the invention. The seven horns 26 may be mounted between two spaced circular plates 27 and 28 which are suitably spaced from each other by spacing elements 30. Each of the horns 26 is fed by coaxial line such as shown at 31 and which will be subsequently explained in connection with FIG. 3. Also, a stripline may be mounted in the box 32 from which the coaxial lines originate.

Figure 3:
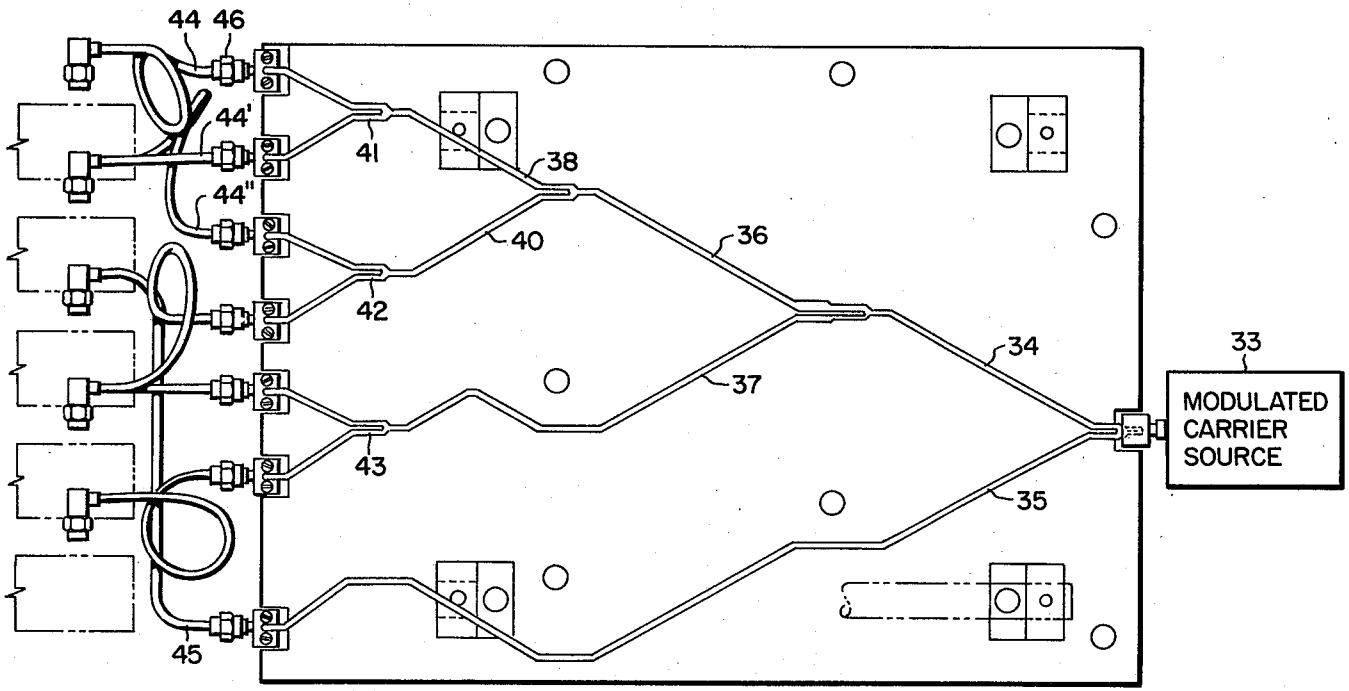
FIG. 3 is a plan view of a stripline power divider for feeding the seven elements of FIG. 2.

Referring now to FIG. 3, there is illustrated apparatus by which the power is distributed from a modulated carrier source 33 to each of the seven horns 26 of FIG. 2. The modulated carrier source 33 feeds power of say 12 units into two striplines 34 and 35 which split the input power equally. Hence six units of power are available from each stripline 34 and 35. The line 34 in turn may be split into two lines 36 and 37 in such a manner that four units of power are available from line 36 and two from line 37. Subsequently, the power from line 36 is again split into two parts and is available from striplines 38 and 40, each of which is again equally split at the junctions 41 and 42 as is the power at the junction 43 connected to the line 37. As a result, the power available at each of the coaxial lines 44, 44', 44" etc. amounts to one unit of power. On the other hand, the electric power available from the coaxial line 45 amounts to six units of power. The significance of the power as supplied by the individual coaxial lines will be subsequently explained.

It should be noted that the individual coaxial cables such as 44 and 45 may have different physical lengths. The reason for this is that they should all have identical electrical length between each stripline and the associated horn so that the signals delivered to each of the horns are in phase. It will be understood that the connectors such as 46 will provide a suitable electrical transfer between the individual striplines such as 35 and the corresponding associated coaxial cables.

Figure 4:
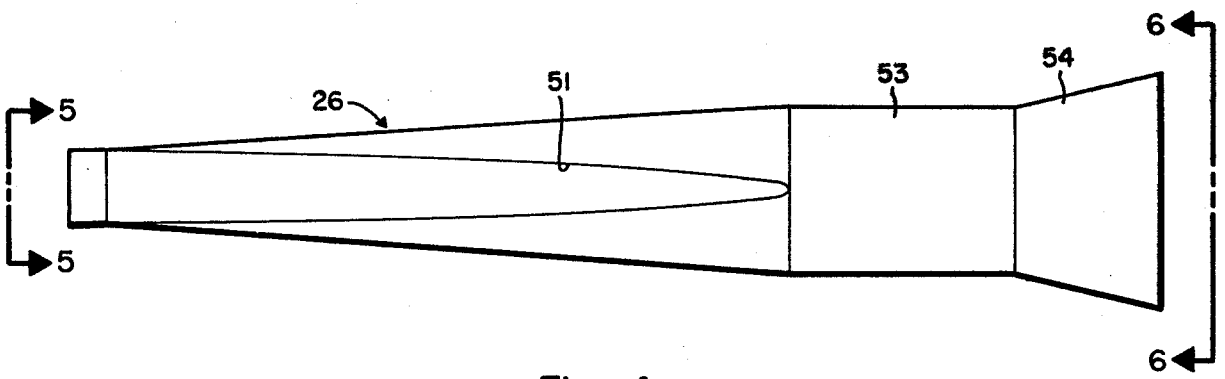
FIG. 4 is a side elevational view of one of the horns of FIG. 2.
Figure 6:
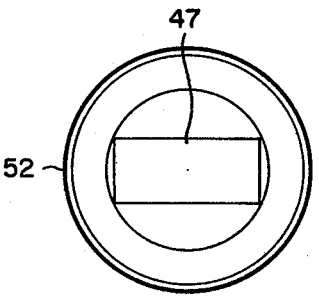
FIG. 6 is an end elevational view taken on lines 6 — 6 of FIG. 4.
Figure 5:
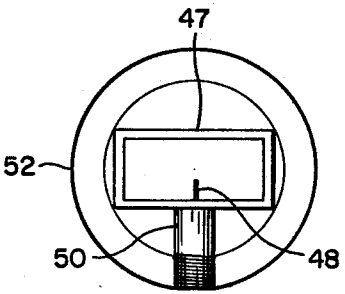
FIG. 5 is an end elevational view taken on lines 5 — 5 of FIG. 4.
Figure 7:
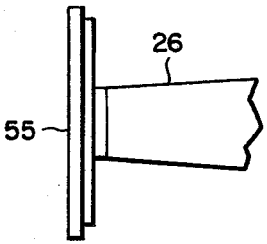
FIG. 7 is a side elevational view of a mounting for the horn of FIG. 4.

Reference is now made to FIGS. 4 - 7 which illustrate the constructional details of one of the horns such as horn 26. The horns are designed to provide a transition between a waveguide of rectangular cross-section and one of circular cross-section. Thus, as shown in FIG. 5, the narrow end portion of the horn 26 consists of a rectangular portion 47 which may be excited by a probe 48 forming part of the associated coaxial cable 50. As clearly shown at 51, the horn 26 has flat surfaces on opposite sides which gradually taper into a circular outline as shown at 52 in FIGS. 5 and 6. As shown at FIG. 4, the horn may have a cylindrical portion 53 which ends in an outwardly flared portion 54. FIG. 7 illustrates a flange 55 connected to the horn 26. The flange 55 may connect to the rectangular waveguide 47 and probe 48.

It will thus be evident that each of the horns such as 26 is fed from a modulated carrier source in such a manner that the waves are in phase at each horn, but may have different power. This will presently be explained in more detail in connection with FIGS. 12 - 15.

Figure 8:
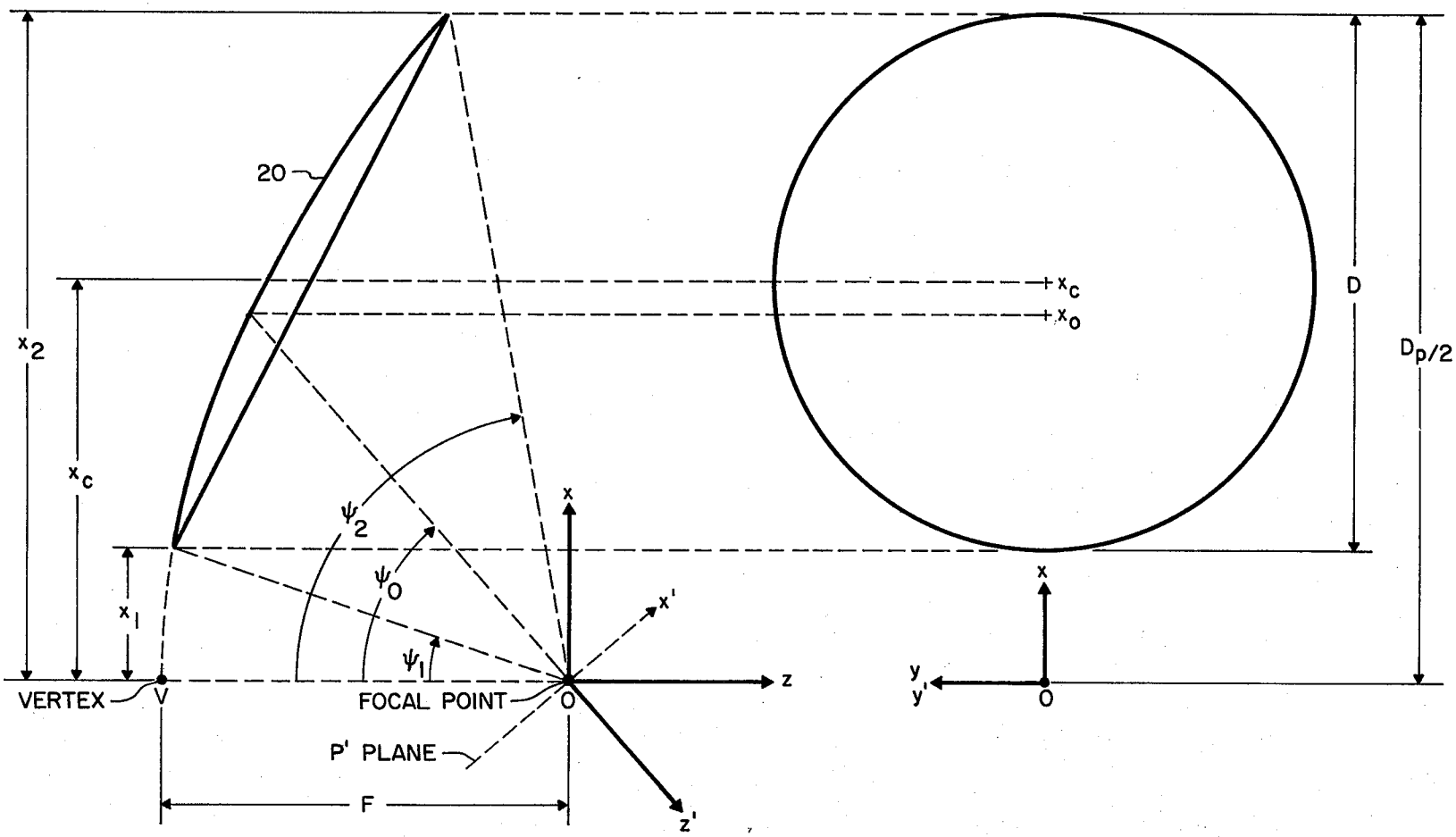
FIGS. 8, 9, 10*a* and 10*b* are geometric representations of a paraboloid reflector and its focal point and will be used in explaining the construction of the antenna system illustrated in FIGS. 1 – 7.
Figure 9:
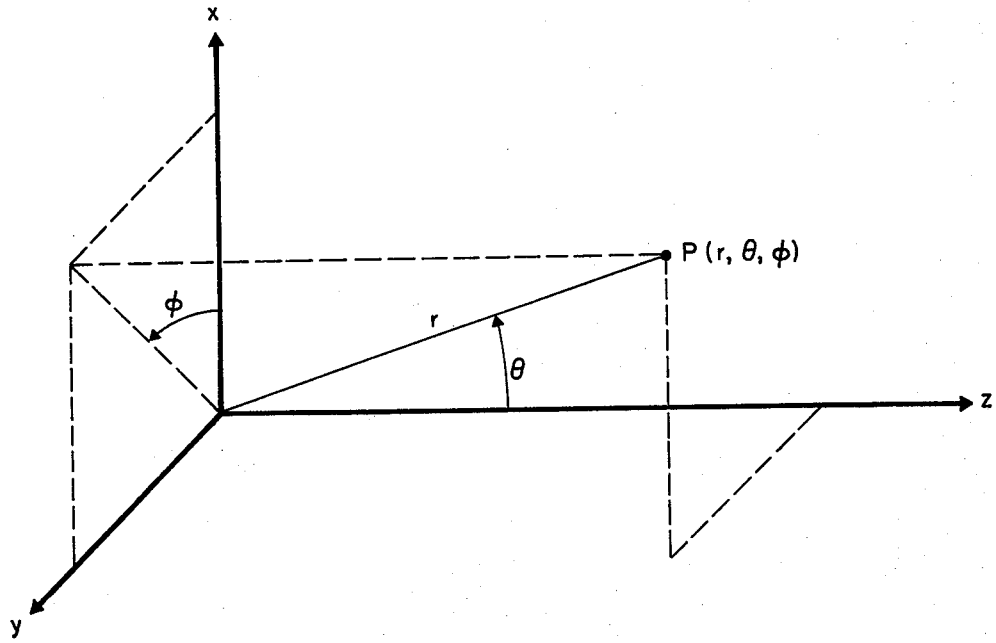

Reference is now made to FIGS. 8, 9, 10a and 10b. These figures show the geometric relationship between an offset paraboloidal reflector and a multiarray antenna feed. In addition they show the relationship between the coordinates of the feed plane and the primary coordinates which relate to the focal point of the reflector. FIG. 8 shows the reflector and the rectangular coordinate system (x,y.z) used to define the reflector geometry. FIG. 9 shows the spherical coordinate system ($r$, $\theta$, $\phi$) used to describe radiation patterns of the antenna. Antenna patterns are calculated and displayed as a function of the polar angle $\theta$ measured from the z axis for a fixed value of the angle $\theta$. The yz plane pattern is obtained for $\phi = \pi/2, 3\pi/2$.

The reflector 20 comprises an off-axis sector of a paraboloid of revolution (parent paraboloid) of diameter $D_p$ and focal length F. The paraboloid focal point is located at the origin O of the rectangular coordinate system ($x,y,z$). The reflector surface (off-axis sector) is defined by the intersection of a right circular cone of half-angle $(\psi_2-\psi_1)/2$ with the surface of the parent paraboloid. The axis of the cone (the negative $z'$ axis) lies in the $xz$ plane at angle $\psi_o = (\psi_1+\psi_2)/2$ from the negative $z$ axis. The projected aperture of the offset reflector in the $xy$ plane is circular in cross-section with a diameter D. In the view normal to the xz plane, the lower extremity of the reflector is defined by coordinate $x_1$ and the corresponding angle $\psi_1$. The upper extremity is defined by coordinate $x_2$ and the corresponding angle $\psi_2$, where $x_2 = D_p/2$. In practice, dimension $x_1$ is selected to ensure that the feed system does not block the aperture of the reflector (does not intercept rays that emanate from the reflector surface and which are drawn parallel to the $z$ axis). Angles $\psi_1$ and $\psi_2$ are defined by the equations $$\left.\begin{aligned}\tan\left(\frac{\psi_1}{2}\right)&=\left(\frac{x_1}{2F}\right)\\ \tan\left(\frac{\psi_2}{2}\right)&=\frac{1}{4\left(\frac{F}{D_p}\right)}\end{aligned}\right\} \quad (1)$$

It is clear that $x_1 + D = D_p/2$ and that the center of the projected circular aperture occurs at $x_c = x_1 + D/2$, $y = 0$.

Figure 10A:
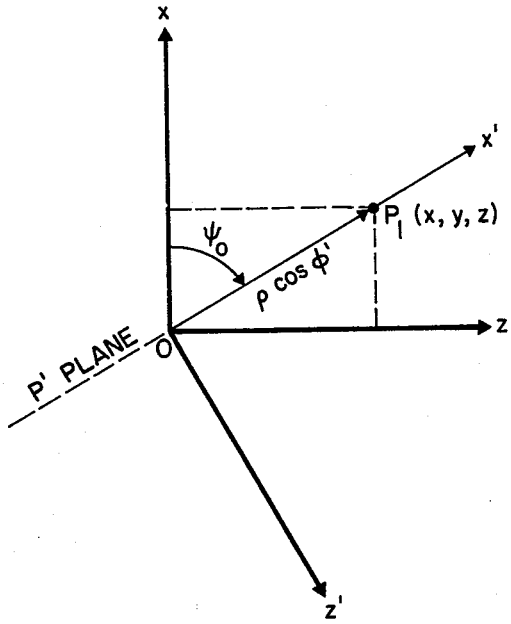
Figure 10B:
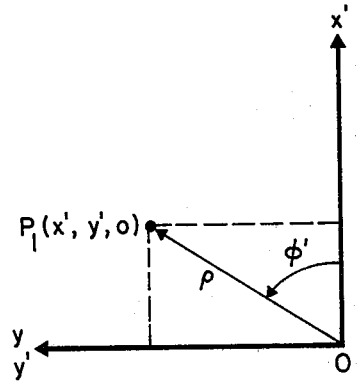

A single feed element (a horn or waveguide radiator, for example) is located with its phase center at the origin O and with the horn axis of symmetry elevated to the angle $\psi_o$ so that the horn radiation pattern is directed along the negative $z'$ axis. Multiple feed elements (an array of horns, for example) are disposed with their phase centers located in the P' plane which is a plane passing through the origin and which is normal to the $z'$ axis. It follows that the P' plane is normal to the $xz$ plane and contains the $y$ axis. The intersection of the P' plane with the $xz$ plane is indicated by the dashed line in FIG. 8. The relationship between the feed plane (P' plane) coordinates $(x',y',0)$ and the primary coordinate system $(x,y,z)$ is shown in FIGS. 10a and 10b. A feed element located with its phase center at position $P_1$ has P' plane coordinates $$\left.\begin{aligned}x'&=\rho\cos\phi'\\ y'&=\rho\sin\phi'\\ z'&=0\end{aligned}\right\} \quad (2)$$

where $\rho = \sqrt{(x')^2 + (y')^2}$ and $\tan\phi' = (x'/y')$. The primary coordinates corresponding to the P' plane coordinates of point $P_1$ are $$x = \rho\cos\phi'\cos\psi_o$$

$$y = \rho\sin\phi'$$

$$z = \rho\cos\phi'\sin\psi_o \quad (3)$$

Note that $y$ and $y'$ are identical in the two coordinate systems. When a collection of horns or similar radiators are disposed with their phase centers located in the P' plane, the horn axes (that is, the element radiation pattern axes) are directed normal to the P' plane in the negative $z'$ direction.

Figure 11:
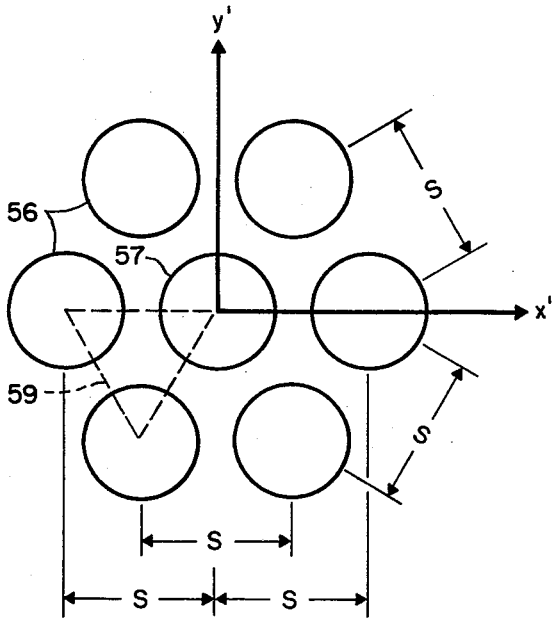
FIG. 11 is a schematic or plan view of a basic subarray consisting of seven radiating elements.

Referring now to FIG. 11, there is illustrated a schematic view of a basic seven-element subarray of the type illustrated in FIG. 2. It will, of course, be understood that each of the radiating elements instead of being a horn may consist of an open-ended waveguide or alternatively of two pairs of crossed dipoles of the type illustrated in FIG. 16, of slot array feeds or single or crossed slots and similar well known radiators.

The drawing of FIG. 11 may be considered to be a plan view of the subarray of radiators. As explained hereinabove, the array consists of six circularly arranged radiators 56, and a central radiator 57. As shown by the dotted lines 59, the elements form equilateral triangles and the spacing between adjacent elements is S as shown. Also, a coordinate system $x'$ and $y'$ has been shown corresponding to the coordinate system, for example, of FIG. 10b. The circles shown in FIG. 11 correspond to the positions of the elements in the P' plane previously referred to. The center of each circle defines the center of the element location or of the phase of the wave.

The voltage amplitude coefficients of the outer or circular elements 56 are equal and may be designated $a_o$, while those of the central element 57 are obtained by multiplying $a_o$ by a constant $k$ ($ka_o$).

It should be noted that the constant k is a positive, real number. It depends on the configuration of the reflector or lens illuminated by the array. Hence, it is a unique characteristic of the basic subarray of FIG. 11 that the voltage amplitude coefficients of each of the radiating elements are real rather than complex. This, of course, means that the array elements are electrically in phase and only differ from each other by their amplitude or power.

The spacing S and the value of the constant k are determined by optimizing the mean sidelobe amplitude of the radiation pattern produced by the subarray of FIG. 11 when used as a feed for a lens or an offset reflector. It has been found that the spacing S is typically in the range between $\frac{3}{4}\lambda$ and $5/4\lambda$ where $\lambda$ is the wavelength of the signal or wave. Specifically, S is approximately equal to that spacing which causes the main beams consisting of the principal maxima of the diffraction patterns produced by two adjacent feed elements to intercept or cross over at a relative gain level of $-3$ db. Stated another way, S is approximately equal to that spacing that causes the angular separation between the maxima of two adjacent beams to correspond to the included beam width of a spot beam at the half power or $-3$ db level. For a number of offset reflectors the optimum value of S was found to be approximately $1.0\lambda$.

A study of a number of lens and reflector configurations has revealed that the constant $k$ is in the range between 2 and 3. For some particular offset reflectors the optimum value of $k$ was found to be 2.45.

It is, of course, well known that the power amplitude coefficient for each element is proportional to the square of the voltage amplitude coefficient. Thus, as previously indicated, in connection with FIG. 3, if $a_o$, the power fed to each of the outer elements 56 is one, the central element is excited with $k^2$ which is approximately six units of power. The distribution network of FIG. 3 has been designed with these values in mind. The six units of power correspond approximately to 2.45 squared, the value previously found for $k$. Hence, it will be evident that the total power delivered to the subarray is 12 units, half of which is used to drive the central element 57 and the remainder is used in equal amounts to drive the outer circular elements 56.

Although the basic seven element array of FIG. 11 has been shown in a particular orientation with respect to the $x'$, $y'$ axis, this is purely for convenience. It has been found that the radiation characteristics of the subarray of FIG. 11 are independent of the array position. Therefore, the subarray can be arbitrarily translated or rotated from the position shown in FIG. 11.

Table 1 shown below summarizes the element locations and excitation coefficients as discussed and shown in FIG. 11.

TABLE 1.

| x'/S | y'/S | Voltage Amplitude Coefficient |
|---|---|---|
| 0 | 0 | $ka_o$ |

TABLE 1.-continued

| x'/S | y'/S | Voltage Amplitude Coefficient |
|---|---|---|
| 1.0 | 0 | $a_o$ |
| −1.0 | 0 | $a_o$ |
| 0.5 | 0.866 | $a_o$ |
| −0.5 | 0.866 | $a_o$ |
| 0.5 | −0.866 | $a_o$ |
| −0.5 | −0.866 | $a_o$ |

Figure 12:
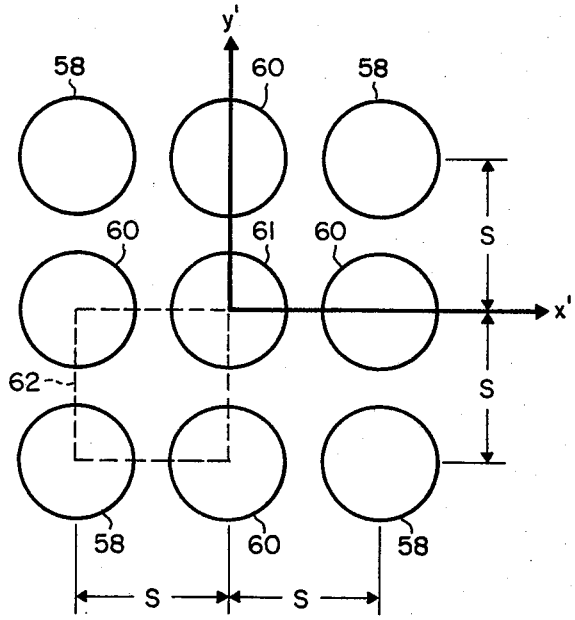
FIG. 12 is a schematic or plan view of another basic subarray in accordance with the present invention consisting of nine radiating elements.

Referring now to FIG. 12, there is illustrated another basic subarray in accordance with the present invention. This subarray consists of nine elements which are arranged in three rows of three elements each. The four corner elements are shown at 58. The four side elements are designated at 60 and the central element is shown at 61. It may be arbitrarily assumed that the elements 58 have a voltage amplitude coefficient $a_o$, the elements 60 have a coefficient $a_1$ and finally the element 61 has a coefficient $a_2$. Again it should be noted that the corresponding voltage amplitude coefficients are real and not complex and therefore the respective radiators are electrically in phase with each other.

Again the distance or spacing between two adjacent elements such as 58 and 60 is S. The array has been shown in a particular orientation with respect to the $x'$, $y'$ axes. It will be noted from the dotted line 62 that four adjacent elements are disposed on a square.

A value of S is again obtained in the manner previously described by an optimum study to minimize mean sidelobe amplitudes. Again by studying a number of offset reflectors, it has been found that a typical value for S is 1.0 λ. Also from a study of the amplitude ratios $a_{1/ao}$ and $a_2/a_1$, it has been found that $a_1 = ka_o$ and $a_2 = ka_1$. In this case $k$ is approximately 2.45.

The element locations and excitation coefficients of the basic subarray of FIG. 12 are shown in Table 2 below.

TABLE 2

| x'/S | y'/S | Voltage Amplitude Coefficient |
|---|---|---|
| 1.0 | 1.0 | $a_o$ |
| 1.0 | 0 | $a_1 = ka_o$ |
| 1.0 | −1.0 | $a_o$ |
| 0 | 1.0 | $a_1 = ka_o$ |
| 0 | 0 | $a_2 = k^2a_o$ |
| 0 | −1.0 | $a_1 = ka_o$ |
| −1.0 | 1.0 | $a_o$ |
| −1.0 | 0 | $a_1 = ka_o$ |
| −1.0 | −1.0 | $a_o$ |

As in the case of the array of FIG. 11, the nine-element array of FIG. 12 has radiation characteristics which are independent of the array position relative to the origin $x' = 0$, $y' = 0$. Therefore, the subarray of FIG. 12 may take any position in the P' plane.

The subarrays of FIGS. 11 or 12 when used to feed a lens or reflector produce essentially a spot beam of circular cross-section with negligible sidelobes. In other words, each beam has a substantially Gaussian distribution and substantially no sidelobes. It is now possible to superposition a plurality of subarrays to define a larger array of feed elements. This will produce a beam of a shaped or predetermined cross-section. How this can be effected by utilizing the basic seven-element subarray of FIG. 11 will now be explained in connection with FIGS. 13, 14 and 15. It will be understood that the same procedure applies equally well to the nine-element basic subarray of FIG. 12.

Figure 13:
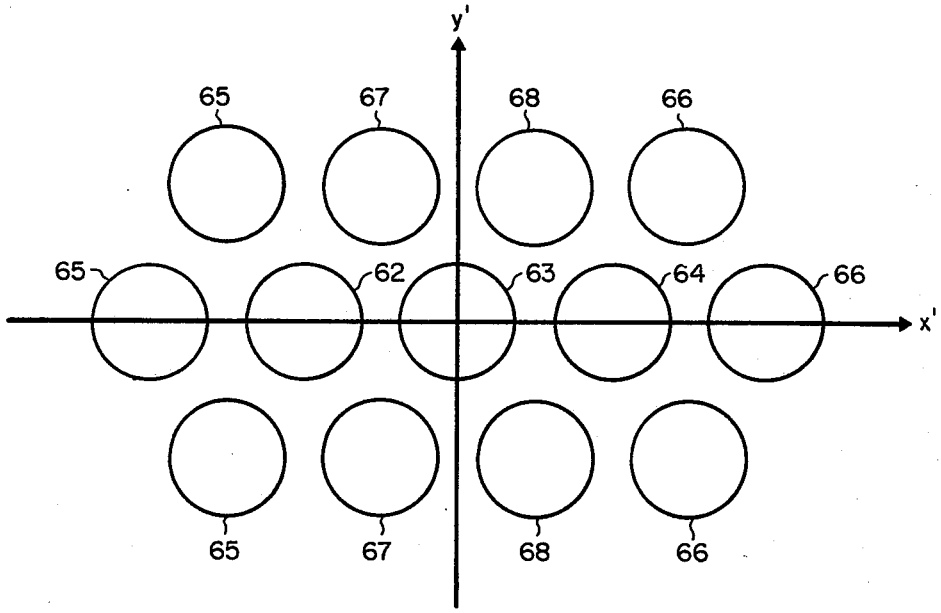
FIG. 13 is another schematic or plan view of an antenna array consisting of thirteen radiating elements obtained by a superposition of several of the subarrays of FIG. 11.
Figure 15:
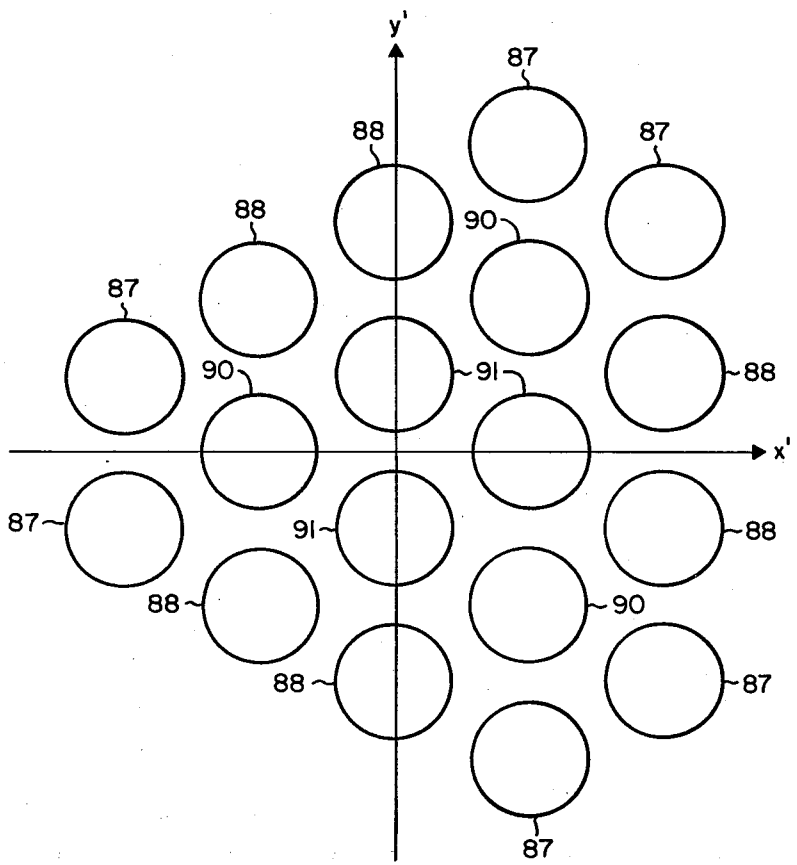
FIG. 15 is still another schematic or plan view of an antenna array consisting of eighteen radiating elements to provide a triangular-shaped beam and which may be obtained by a superposition of several of the basic subarrays of FIG. 11.

Thus, referring to FIG. 13, there is shown an antenna array consisting of thirteen elements which may, for example, be obtained by the superposition of two seven-element arrays of the type shown in FIG. 11. Thus, the array of FIG. 13 may be considered to have three central elements 62, 63 and 64 corresponding to the two seven-element subarrays of which it consists. The array of FIG. 13 additionally may be considered to have sets of outer elements such as the three outer elements 65, the three outer elements 66, the two outer elements 67 adjacent the elements 65 and the last two outer elements 68 adjacent the elements 66.

The voltage amplitude coefficients of the elements 65 and 67 may be designated $a_1$ and similarly those of the elements 66 and 68 may be designated $a_3$ corresponding to the two seven-element subarrays of which it consists. Accordingly, the coefficients of the central elements 62, 63 and 64 are respectively $ka_1$, $(a_1 + a_3)$ and $ka_3$. In other words, it may be considered that the array of FIG. 13 consists of two seven-element basic subarrays. In this case, only the element 63 is common to the two arrays.

However, a second alternative consists by considering that the array of FIG. 13 if formed by the superposition of three seven-element basic subarrays. In this case, the voltage amplitude coefficients of element 65 is again $a_1$ and similarly those of element 66 is $a_3$. However, the coefficients of elements 67 are $(a_1 + a_2)$ while those of elements 68 are $(a_2 + a_3)$. Finally, the coefficients of the three central elements 62, 63 and 64 are respectively $(ka_1 + a_2)$, $(a_1 + ka_2 + a_3)$, and $(a_2 + ka_3)$.

The shape of the beam resulting from the superposition of subarrays depends upon the amplitudes of the subarray sets relative to each other. In addition, it depends on the geometric disposition of the elements. Hence, the array of FIG. 13 will generally produce beams of elliptical cross-section.

Figure 14:
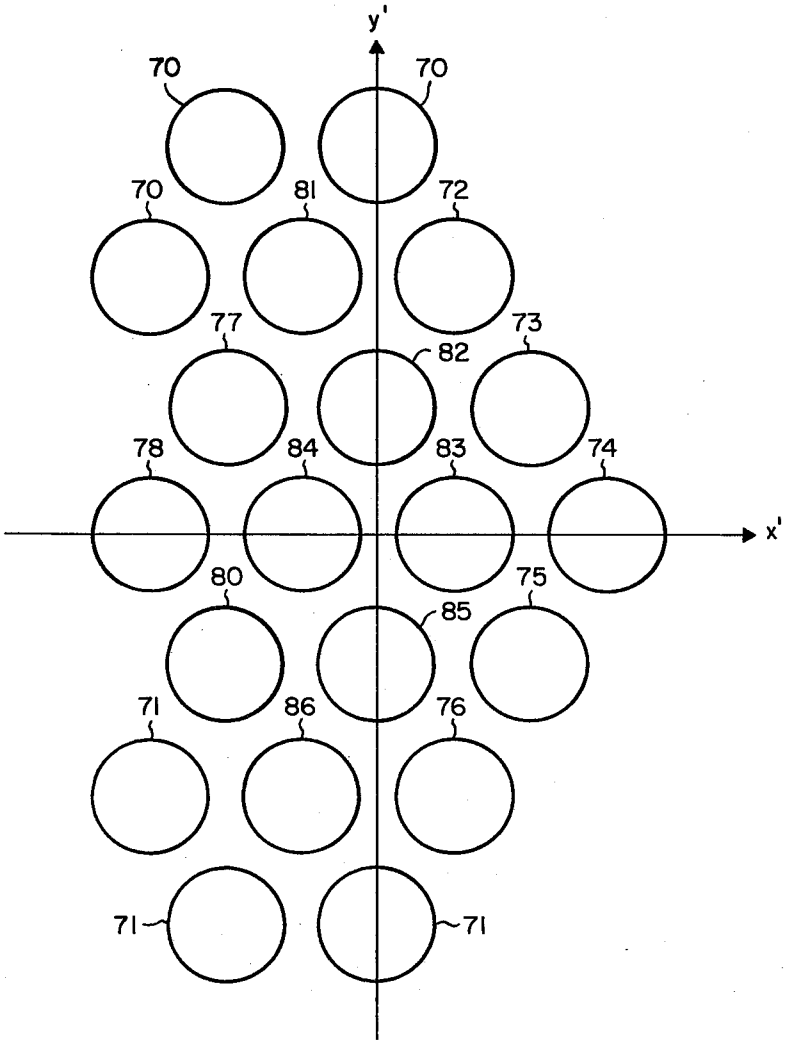
FIG. 14 is another schematic or plan view of an antenna array consisting of twenty radiating elements also obtained by a superposition of several basic subarrays of the type shown in FIG. 11.

It should be noted that linear superposition includes not only the addition of subarray sets but the subtraction of subarray sets as well. The subtraction is readily achieved by feeding one subarray 180° electrically out of phase with respect to the other. This can be used to introduce a null in the radiation pattern. A more complex antenna array is illustrated in FIG. 14. This consists of twenty elements and may be considered to be obtained by superimposing six hexagonal subarrays of the type shown in FIG. 11.

The outer elements 70 may have voltage amplitude coefficients $a_1$. The corresponding three outer elements 71 may have coefficients $a_6$. Adjacent outer elements 72 and 73 have coefficients $(a_1 + a_2)$ and $(a_2 + a_3)$, respectively. Element 74 has a coefficient $a_3$. Element 75 has a coefficient $(a_3 + a_5)$ and element 76 has a coefficient of $(a_5 + a_6)$. The corresponding other outer elements 77, 78, and 80 have coefficients $(a_1 + a_2 + a_4)$, $a_4$, and $(a_4 + a_5 + a_6)$, respectively. Finally, the six central elements 81, 82, 83, 84, 85 and 86 have coefficients $b_1$, $b_2$, $b_3$, $b_4$, $b_5$, and $b_6$.

Thus it will be evident that the central element 81 has six surrounding peripheral elements each with an amplitude $a_1$ etc. By providing in this manner, a set of linear simultaneous equations can be set up which can be solved for the unknown coefficients $a_1$, where $i$ has one of the numbers 1 to 6. The corresponding coefficients $b_i$ define the amplitude distribution that results over the composite array of superposed basic subarrays.

This set of equations can be written in matrix form as follows:

$$\begin{bmatrix} k & 1 & 0 & 0 & 0 & 0 \\ 1 & k & 1 & 1 & 0 & 0 \\ 0 & 1 & k & 1 & 1 & 0 \\ 0 & 1 & 1 & k & 1 & 0 \\ 0 & 0 & 1 & 1 & k & 1 \\ 0 & 0 & 0 & 0 & 1 & k \end{bmatrix} \begin{bmatrix} a_1 \\ a_2 \\ a_3 \\ a_4 \\ a_5 \\ a_6 \end{bmatrix} = \begin{bmatrix} b_1 \\ b_2 \\ b_3 \\ b_4 \\ b_5 \\ b_6 \end{bmatrix} \quad (4)$$

A particular solution of the matrix (4) has been obtained for the case where $k = 2.45$, $b_1 = 10.0$, $b_2 = 10.467$, $b_3 = 10.467$, $b_4 = 7.0$, $b_5 = 10.467$, and $b_6 = 10.0$ With these values the solution of the matrix (4) yields the following results $$\begin{aligned} a_1 &= 3.470 \\ a_2 &= 1.499 \\ a_3 &= 2.858 \\ a_4 &= 0.467 \\ a_5 &= 1.499 \\ a_6 &= 3.470 \end{aligned} \quad (5)$$

The element positions and amplitude coefficients for the array of FIG. 14 are presented in Table 3.

TABLE 3

| x'/S | y'/S | Voltage Amplitude Coefficient |
|---|---|---|
| 0 | 2.598 | 3.47 |
| −1.0 | 2.598 | 3.47 |
| 0 | −2.598 | 3.47 |
| −1.0 | −2.598 | 3.47 |
| 0.5 | 1.732 | 4.969 |
| −0.5 | 1.732 | 10.0 |
| −1.5 | 1.732 | 3.47 |
| 0.5 | −1.732 | 4.969 |
| −0.5 | −1.732 | 10.0 |
| −1.5 | −1.732 | 3.47 |
| 1.0 | 0.866 | 4.357 |
| 0 | 0.866 | 10.467 |
| −1.0 | 0.866 | 5.436 |
| 1.0 | −0.866 | 4.357 |
| 0 | −0.866 | 10.467 |
| −1.0 | −0.866 | 5.436 |
| −1.5 | 0 | 0.467 |
| 1.5 | 0 | 2.858 |
| 0.5 | 0 | 10.467 |
| −0.5 | 0 | 7.0 |

It should be noted that it is not necessary to define as many as six central elements in the array of FIG. 14. For example, the element 82 may be considered to be a peripheral element rather than the central element of a hexagonal subarray.

It is also possible to superposition six hexagonal basic subarrays of the type shown in FIG. 11 to produce a triangular-shaped beam. Such an arrangement has been illustrated in FIG. 15. Here the six elements 87 may have a voltage amplitude coefficient of $a_o$. The six elements 88 may have a coefficient of $2\ a_o$. The three central elements 90 may have a coefficient of $(a_1 + 2\ a_o)$ and finally the three remaining elements 91 may have a coefficient of $(a_1 + 4\ a_o)$.

From what has been explained hereinabove, it will now be readily apparent how multiarray antennas may be designed and the distances between elements and the power fed to each element may be easily determined.

It will be apparent that the antenna arrays of the invention are also suitable for multibeam antennas. In other words, it is feasible to generate simultaneously more than one beam by energizing different radiators of the system with different signals. Thus, each beam may carry different information or different programs. The beams may be distinguished, for example, by their direction of polarization or by the fact that one beam is circularly polarized in the left-hand manner and the other one is circularly polarized in the right-hand direction.

As indicated hereinabove, many other types of radiators may be used instead of the horns illustrated, for example, in FIGS. 2 and 4 - 7.

Figure 16:
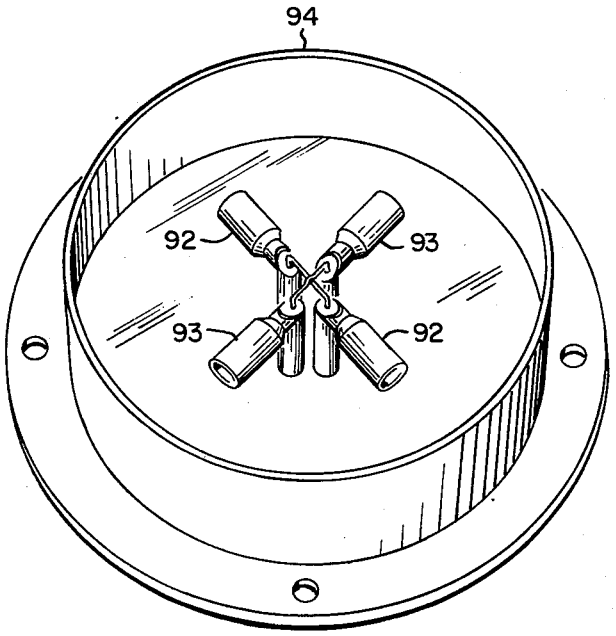
FIG. 16 is a view in perspective of a pair of crossed dipoles disposed in a reflecting cup which may be used as one of the radiating elements of the antenna array of the invention.

Thus, by way of example, FIG. 16 illustrates two pairs of crossed dipoles disposed in a reflecting cup. As shown in FIG. 16, there are provided two pairs of dipoles 92 and 93. They excite a cup 94 consisting of a reflecting cylinder. The respective dipoles are excited 90° apart in time phase. They may, for example, be driven by a 90° hybrid. The result is that a circularly polarized beam is radiated by each of the cups 94. It will readily be apparent that in this manner a circularly polarized beam may be obtained which is polarized either in the right-hand or the left-hand direction.

Figure 17:
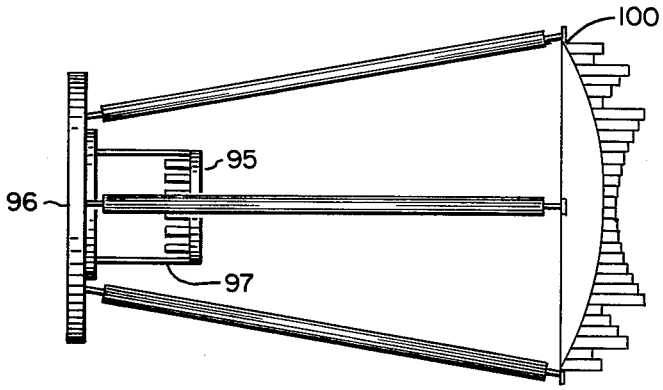
FIG. 17 is a side elevational view of an antenna array in accordance with the present invention utilizing a zoned metal waveguide lens instead of a reflector.

Instead of utilizing a reflector it will be obvious that a lens may be used instead. It will be evident from general principles of optics that any reflector may be replaced by a lens. Such an arrangement is illustrated in FIG. 17. Here there is shown again an antenna array 95 mounted on a plate 96 by suitable mounts 97. Spaced from the array is a lens 100 which may, for example, consist of a zoned metal waveguide lens of conventional construction. As clearly shown in FIG. 17, a lens waveguide may be stepped to remove one wavelength section, for example, in order to reduce the weight of the lens. It should be noted, however, that such lenses are well known in the art and form no part of the invention.

The antenna illustrated in FIGS. 1 - 7 has been reduced to practice and tested. This antenna corresponds to the basic seven-element subarray of FIG. 11. The antenna had seven circular waveguide horns. The horn aperture diameter was 1.0 λ corresponding to 3.0 inches at a frequency of 3.95 gigahertz. The spacing S was 1.0 λ so that the horn apertures are contiguous. The reflector as shown in FIG. 1 has the following dimensions.

| | | |
|---|---|---|
| Aperture Diameter | $D =$ | 72 inches |
| Focal Length | $F =$ | 54 inches |
| Dimension | $x_1 =$ | 18 inches |
| Dimension | $x_c =$ | 54 inches |
| Parent Parabaloid Diameter | $D_p =$ | 180 inches |
| | $F/D_p =$ | 0.3 |
| | $\psi_o =$ | 49.25 degrees |

Figure 18:
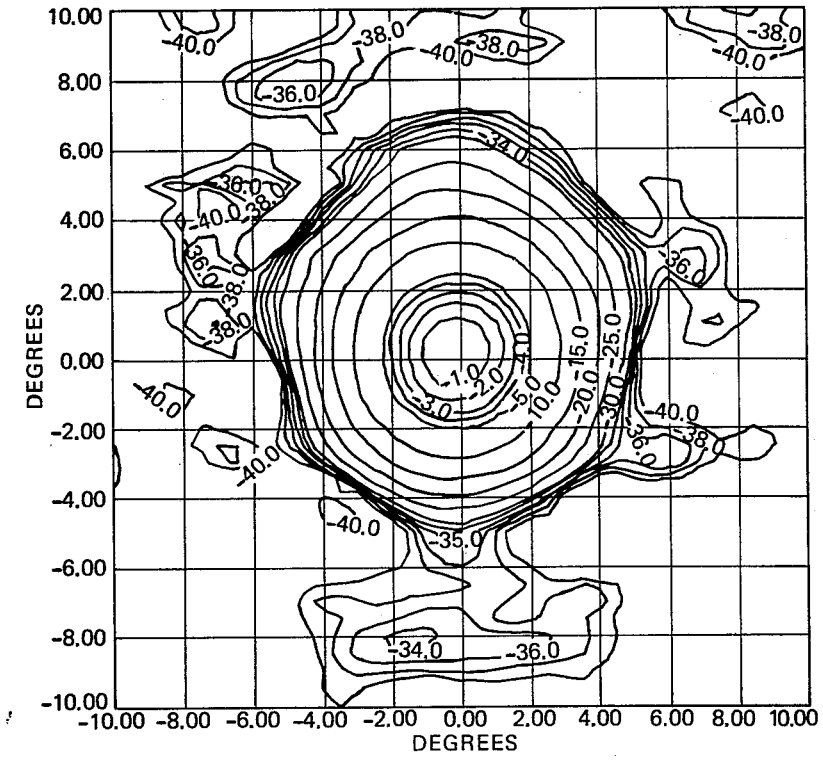
FIG. 18 is a graph of the measured radiation pattern of a reflector of the type illustrated in FIG. 11 at a frequency of 3.95 gigahertz.

The radiation pattern of this antenna was measured at a frequency of 3.95 gigahertz. This radiation pattern is illustrated in FIG. 18. The numbers shown adjacent the closed curves correspond to dB.

Figure 19:
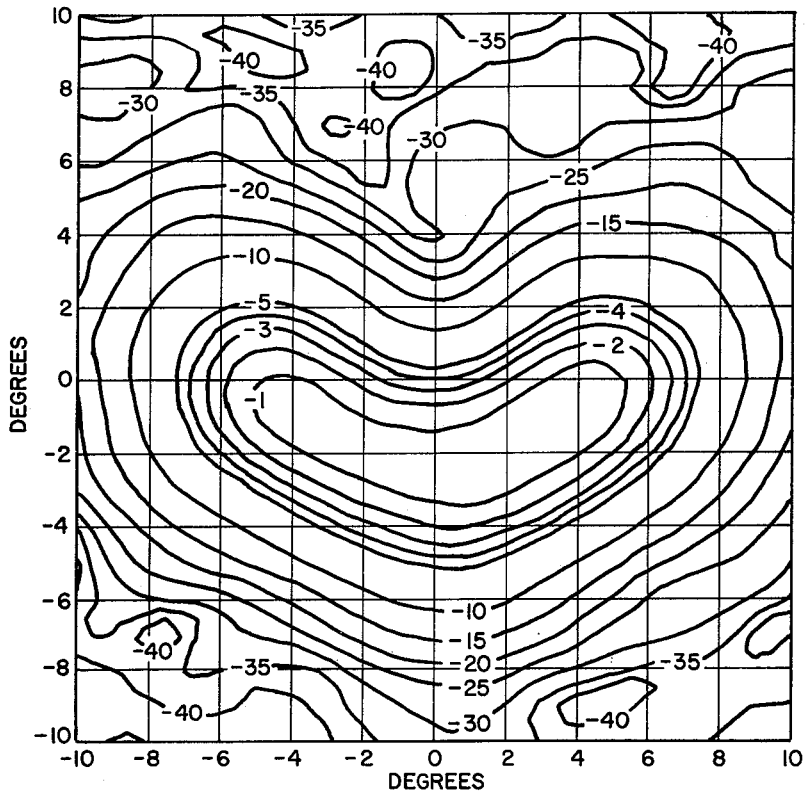
FIG. 19 is a graph showing the measured gain contours of the twenty-element array of FIG. 14 utilizing pairs of crossed dipoles as shown in FIG. 16 in lieu of the horn radiators of FIGS. 1 - 7.

Also, an antenna corresponding to the configuration of FIG. 14, that is a twenty element array, was built and tested. In this case the radiators consist of the crossed dipoles of FIG. 16 mounted in a cup. The cup diameter was 1.0 λ and the spacing S was also 1.0 λ so that the cup apertures are contiguous. A stripline power divider was used to provide the excitation coefficients as shown in Table 3. The resulting antenna pattern is illustrated in FIG. 19. Again, the numbers associated with the closed curves correspond to intensity in dB. The radiation pattern was measured at a frequency of 3.83 gigahertz. The offset paraboloid had the following dimensions:

| | | |
|---|---|---|
| Aperture Diameter | $D =$ | 60 inches |
| Focal Length | $F =$ | 45 inches |
| Dimension | $x_1 =$ | 15 inches |
| Dimension | $x_c =$ | 45 inches |
| Parent Parabaloid Diameter | $D_p =$ | 150 inches |
| | $F/D_p =$ | 0.3 |

-continued

| | |
|---|---|
| $\psi_o =$ | 42.25° |

There have thus been disclosed antenna systems characterized by a resulting beam having very low sidelobes. In other words, the beam has a substantially Gaussian distribution. The beam can be shaped into a predetermined pattern by the superposition of two or more basic subarrays. Procedures have been given how to calculate or optimize the distance between adjacent elements and the power fed into the elements. The procedure is particularly simple because the radiating elements are in phase so that voltage amplitude coefficients are real rather than complex numbers. Complex beam shapes may readily be obtained by superposition of the basic subarrays and various examples have been given how this can be accomplished.

What is claimed is:

1. A low sidelobe antenna system comprising:
   a. an odd number of substantially identical regularly spaced radiating elements arranged in a predetermined planar geometric pattern and forming a basic subarray;
   b. means for feeding each of said radiating elements with a wave to be radiated in such a manner that said elements are electrically in phase and that each element is fed with a predetermined power, the power fed to said radiating elements being different, a plurality of said basic subarrays are superimposed over each other to form an array generating a beam of predetermined configuration and the spacing between all of said elements being equal, the power and spacing being so selected that a resulting beam has a substantially Gaussian distribution with substantially no sidelobes; and
   c. means for focusing the beam radiated by said elements.

2. An antenna system as defined in claim 1 wherein said means for focusing consists of a paraboloidal reflector so disposed that said radiating elements illuminate said reflector in an offset manner.

3. An antenna system as defined in claim 1 wherein said means for focusing consists of a lens.

4. An antenna system as defined in claim 1 wherein each of said radiating elements consists of a horn.

5. An antenna as defined in claim 1 wherein each of said radiating elements consists of two pairs of crossed dipoles.

6. An antenna system as defined In claim 1 wherein the number of said radiating elements of said basic subarray is 7.

7. An antenna system as defined in claim 1 wherein the number of radiating elements of said basic subarray is 9.

8. A low sidelobe antenna system comprising:
   a. a plurality of substantially identical radiating elements, said elements forming a basic subarray of 7 elements, said elements having equal spacing from each other and consisting of six outer elements disposed in a circle and a central element;
   b. means for feeding each of said elements with a wave to be radiated in such a manner that the elements are electrically in phase with each other and so that the power fed to each of said outer elements is equal and that the power fed to said central element is substantially six units of the power fed to each outer element; and
   c. means for focusing the beam radiated by said elements.

9. An antenna system as defined in claim 8 wherein the spacing between said elements is so determined as to cause angular separation between the maxima of two adjacent beams produced by two adjacent elements to be one-half power beam width.

10. A low sidelobe antenna system comprising:
   (a) a plurality of radiating elements forming a basic subarray of nine elements arranged in a square of three rows with substantially equal spacing between the adjacent elements;
   (b) means for feeding a wave to each of said elements in such a manner that the wave is electrically in phase at each element and with a first predetermined power to each of the four corner elements and with a second different predetermined power to each of the four side elements and with a third different predetermined power to the central element; and
   (c) means for focusing the beam generated by said elements.

11. A low sidelobe antenna system as defined in claim 10 wherein the power fed to said four side elements is a constant times the power fed to each of said corner elements, and the power fed to said central element is the square of said constant times the power fed to each of said corner elements.

12. An antenna system as defined in claim 10 wherein the spacing between said elements is so determined as to cause angular separation between the maxima of two adjacent beams produced by two adjacent elements to be one-half power beam width.

13. An antenna system as defined in claim 10 wherein a plurality of said basic subarrays are superimposed over each other to form an array generating a beam of predetermined configuration.

14. The method of generating a beam to radiate into an area of predetermined irregular outline with substantially no sidelobes and with a substantially Gaussian distribution, by means of a plurality of radiating elements, said method comprising the steps of:
   (a) generating a basic subarray consisting of six outer elements arranged in a circle and a central element, the elements having equal spacing, the outer elements being fed with the same voltage amplitude and the central element being fed with k times the voltage amplitude of the outer elements;
   (b) selecting the spacing and the factor k in such a manner as to optimize the mean sidelobe amplitude of the radiation pattern provided by the subarray;
   (c) superpositioning a plurality of the subarrays over each other in such a manner as to cover the predetermined irregular area by the thus obtained array; and
   (d) calculating the voltage amplitudes for each element of the array be adding the voltage amplitudes of the corresponding elements of the subarrays forming the array.

* * * * *